United States Patent [19]

Meeh

[11] 4,290,270

[45] Sep. 22, 1981

[54] MARINE PROPULSION UNIT

[75] Inventor: Wilhelm Meeh, Friedrichshafen, Fed. Rep. of Germany

[73] Assignee: Motoren-und-Turbinen-Union Friedrichshafen GmbH, Friedrichshafen, Fed. Rep. of Germany

[21] Appl. No.: 57,284

[22] Filed: Jul. 13, 1979

[30] Foreign Application Priority Data

Jul. 13, 1978 [DE] Fed. Rep. of Germany ..... 2830730

[51] Int. Cl.[3] ..... B63H 23/00

[52] U.S. Cl. ..... 60/716; 440/4

[58] Field of Search ..... 440/4; 60/716

[56] References Cited

U.S. PATENT DOCUMENTS 2,322,014 6/1943 Grant ..... 60/716 X 4,167,857 9/1979 Nishijima ..... 60/716

FOREIGN PATENT DOCUMENTS 614645 12/1948 United Kingdom ..... 60/716

*Primary Examiner*—Alan Cohan

*Attorney, Agent, or Firm*—Craig and Antonelli

[57] ABSTRACT

A marine propulsion unit which includes a propeller selectively coupled directly or by way of gear systems at least to two diesel engines with the propulsion unit being adapted to be operated, in a medium speed range of the ship, with only less than all of the engines and, in a higher speed velocity of the ship, with all engines. At least one of the propeller and the stepdown gear system is constructed so that the propeller, during normal operating conditions and while being propelled by the diesel engines utilized in the range of up to the medium velocities, absorbs the maximum constant output of these engines with the full amount of fuel being injected and, with a maximally permissible engine speed and that, when operating with all engines, the higher propeller speeds are retained in the range of the higher velocities by increasing the speeds of the engines without exceeding their maximum constant output and with a corresponding reduction in the amount of fuel injected to the respective engines.

4 Claims, 4 Drawing Figures

13
16
15
20
19
12
11
14
18
17

24
25
26
22
13
12
11
23
21

MARINE PROPULSION UNIT

The present invention relates to a drive arrangement and, more particularly, to a marine propulsion unit which includes a fixed propeller and diesel engines coupled with the fixed propeller directly or through gear systems having fixed reduction or stepdown gears with the propulsion unit being adapted to be operated with only a portion of the diesel engines in a range up to medium velocities or speed of the ship and with all the engines being operated in a range of higher velocities or ship speed.

A marine propulsion unit of the aforementioned type is proposed in, for example, U.S. Pat. No. 3,232,138, wherein two similar or two different engines serve for the drive or propulsion of a ship's propeller 10 with both of the engines being operatively connected by way of hydrodynamic couplings operable as freewheeling devices with a combining transmission from which is driven the propeller shaft of the ship's propeller. During a normal operation one of the engines, which may be operative at a particular time, transmits in the usual manner its torque to the output by way of the hydrodynamic couplings so as to drive the propeller shaft and the propeller of the ship.

The aim underlying the present invention essentially resides in optimally adapting the engine characteristics to the velocity power characteristic or propeller curve of the ship propeller.

In the construction of propulsion units of the aforementioned type, it has been proposed to operate all of the engines of the propulsion unit along a propeller curve for normal operating conditions, that is, a quiet sea, normal load, and no towing load. However, a disadvantage of this proposal resides in the fact that, during operation of the propulsion unit with less than all of the engines, that is, in a range up to medium ship velocities, the respective engines must be operated at a greatly reduced speed, but such speed reduction is undesirable especially in diesel engines with supercharging.

To counteract the aforementioned disadvantage or difficulties it has been proposed to arrange shiftable gears between the diesel engines and the propeller in order to adapt the r.p.m. of the diesel engines in all operating ranges to a propeller r.p.m. However, a disadvantage of this proposal resides in the fact that considerable additional expenditures are required for constructing such a propulsion unit.

In accordance with advantageous features of the present invention, the propeller and/or stepdown gear system is constructed in such a manner that the propeller, during normal operating conditions and while being propelled by the diesel engines utilized in the range of up to medium velocities, absorbs the maximum constant output of these engines with the full amount of fuel being injected and with a maximally permissible engine speed. When the propulsion unit is operating with all engines the higher propeller speed or r.p.m.'s are attained in the range of higher velocities by increasing the r.p.m.'s of the engines without exceeding their maximum constant output with a corresponding reduction in the amount of fuel injected.

The advantages of an arrangement such as proposed by the present invention resides in the fact that, during operation with only a part of the diesel engines, these diesel engines are not suppressed in their engine speed and, upon occurrence of higher driving resistances with corresponding propeller curves, for example, in rough seas or during a towing operation, these operating ranges can be perfectly executed by the introduction of additional engines with the only prerequisite being that the engines can be operated, in the range of higher driving speeds, with the correspondingly higher engine speeds. By reducing the amount of fuel injected at the higher engine speeds, the combustion chamber pressures and engine stresses occurring at the feasibly constant output are not exceeded.

Accordingly, it is an object of the present invention to provide a marine propulsion unit which ensures a flawless operation of the unit in the range of medium speeds during a cutting out of a portion of the drive engines of the propulsion unit.

Another object of the present invention resides in providing a marine propulsion unit which minimizes the stresses on the driving components such as the diesel engines during operation of the propulsion unit at medium and high speeds. A further object of the present invention resides in providing a propulsion unit which functions reliably at all operating speeds.

A still further object of the present invention resides in providing a propulsion unit which is simple in construction and therefore relatively inexpensive to manufacture.

Yet another object of the present invention resides in providing a propulsion unit which optimizes the engine characteristics to the velocity power characteristics of the propeller of the propulsion unit.

These and other objects, features, and advantages of the present invention will become more apparent from the following description when taken in connection with the accompanying drawings which show, for the purposes of illustration only, one embodiment in accordance with the present invention, and wherein.

Figure 3:
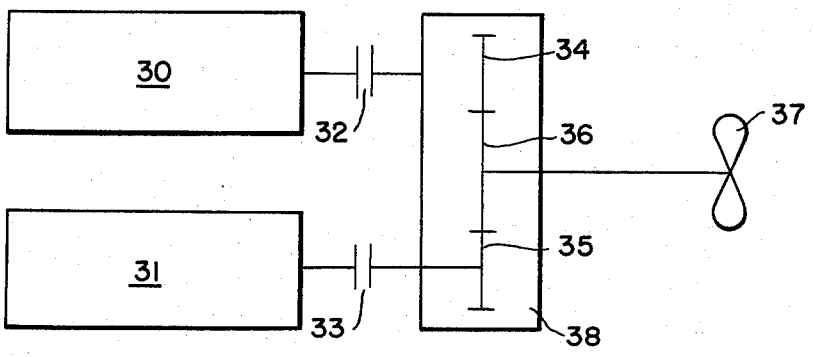
FIG. 3 is a schematic view of an overall arrangement of a propulsion system in accordance with the present invention.

Referring now to the drawings wherein like reference numerals are used through the various views to designate like parts and, more particularly to FIG. 3, according to this figure, two similar or different diesel engines 30, 31 are provided for driving or propelling of a ship's propeller 37. Both engines, 30, 31 are respectively coupled to the ship's propeller 37 by way of couplings 32, 33 and a pair of gears 34, 36 and 35, 36. The gears of the gear system are arranged to a common collective drive 38. The power of one of the drive engines 30,31 is sufficient to produce low or moderate propulsion speeds with the other drive engine being disconnected by an uncoupling of the coupling means 32 or 33.

Figure 1:
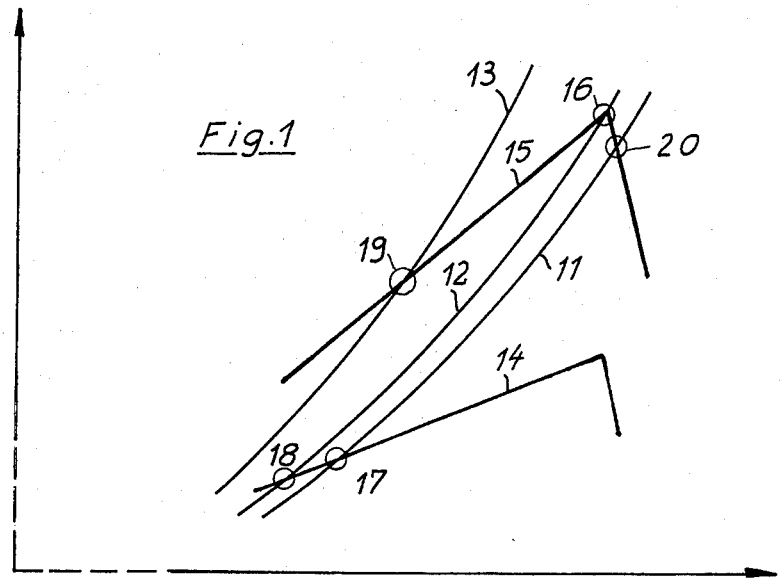
FIG. 1 is a diagram of a characteristic curve of a marine propulsion unit with a fixed propeller and two diesel engines of a conventional construction.
Figure 2:
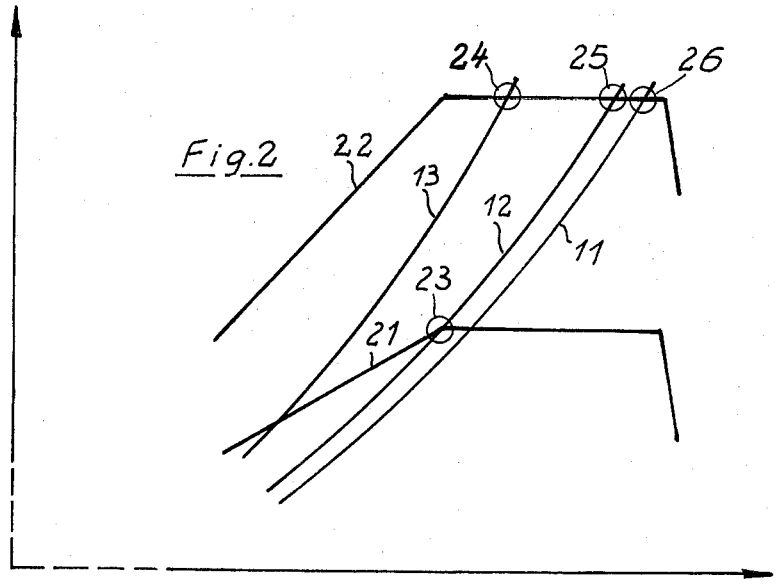
FIG. 2 is a characteristic curve diagram of a marine propulsion unit with a fixed propeller and two diesel engines in accordance with the present invention.

FIGS. 1 and 2 provide an example of the power consumption or power draw curves 11, 12, 13 of the propeller 37 at varying driving resistances plotted over the speed or r.p.m. of the propeller 37. The curve 11 represents the curve of the propeller 37 during good weather with low ballast with the curve 12 representing the curve of the propeller 37 under normal operating conditions, and the curve 13 representing the curve of the propeller 37 during a towing operation by the ship.

FIG. 1 additionally illustrates the engine output curve 14 for driving the propeller 37 with one of the diesel engines 30 or 31 and the engine output curve 15 for driving the propeller 37 with the two diesel engines 30 and 31 in a customary manner. The point designated 16 represents the sum total of the highest constant outputs of both engines 30 and 31 associated with the propeller curve 12 for medium operating conditions. When one of the engines 30 or 31 is cut off, by an uncoupling of either the couplings 32 or 33, so as to allow the propulsion unit to operate in a medium speed range, a strong speed reduction of the engine results as represented by the points designated 17 and 18 with the engine output curve 14 and the power consumption curves 11, 12. However, even if the two engines 30 and 31 were operated at a reduced speed, the lowest possible reduction in speed, for exaple, during towing as represented by the propeller curve 13, is illustrated by the point 19. However, during good weather with low ballast, i.e. the propeller curve 11, the output of the two engines 30, 31 is downwardly controlled by a controller to the point designated by the numeral 20. Thus, the full power of both engines can be utilized only at the point designated 16.

FIG. 2 provides an illustration wherein in addition to the propeller curves 11, 12, 13, an engine power curve 21 for driving the propeller 37 with one diesel engine 30 or 31 and the engine power curve 22 for driving the propeller 37 with both diesel engines, 30, 31, in an arrangement in accordance with the present invention in which the propeller 37 absorbs, during normal operating conditions and when driven by the diesel engine 30 or 31 utilized in the range up to the medium velocities, the maximum constant output of this engine at the full amount of fuel injected and with the maximum r.p.m. designated by the point 23. During operation with both engines 30 and 31, the high speeds of the propeller 37 are achieved in a range of the higher velocities by increasing the r.p.m. of the diesel engines 30, 31 without exceeding the maximum constant output of the respective engines 30,31 with a corresponding reduction of the quantity of fuel injected to the respective engines with the results being designated by the points 24,25, or 26 depending upon the respective operating conditions, i.e. during good weather with low ballast, under normal operating conditions, and during a towing operation represented by curves 11, 12, and 13.

By constructing the propeller 37 and/or the common collective drive 38, it is possible, during normal operating conditions and while the vessel is being propelled by the diesel engines utilized in the range of up to medium velocities, for the propeller 37 to absorb the maximum constant output of the engines 30 or 31 with the full amount of fuel being injected at the maximum permissible speed of the respective engines. Additionally, when operating with both engines 30, 31, the higher speeds of the propeller are attained in the range of higher velocities by increasing the speed of the respective engines 30,31 to a point that does not exceed the maximum constant output of the respective engines by correspondingly reducing the amount of fuel injected to the respective engines 30,31.

In order to obtain the ship drive mechanisms having the characteristics illustrated in FIGS. 1 and 2, a change in the gear reduction of the gears of the gear system of the common collective drive 38 and a change in the governing characteristics of the fuel injected to the respective engines 30,31 is necessary. For example, if the propeller 37 is rotating at 500 rpm under normal running conditions corresponding to the propeller curve 12, at maximum capacity or full power designated by the point 16 in FIG. 1 and the point 25 in FIG. 2, and the maximum allowable rotation of the engine at total or full fuel injection is 1500 rpm, then the necessary gear reduction for the arrangement of FIG. 1 is 1500:500 or 3.0.

In accordance with the marine propulsion unit of the present invention, the characteristic curve of which is illustrated in FIG. 2, a rotational speed of 1500 rpm of the engine should already be present at a rotation of the propeller 37 corresponding to the point 23. When operating with two engines, the rotational speed of the engines at point 25 must be correspondingly higher such as, for example, 1800 rpm, thereby resulting in a gear reduction of 1800:500 or 3.6.

In lieu of a change in the gear reduction of the gears of the gear system of the common collective drive 38, a propeller with other characteristic values such as pitch, diameter, and performance capacity can also come into consideration.

In the marine propulsion unit having the characteristics depicted in FIG. 1, the governor regulated the fuel supply very sharply down for both engines at, for example, 1500 rpm, so that upon reaching only a slightly higher rotational speed, the fuel injection would equal zero. In accordance with the marine propulsion unit of the present invention having the characteristics illustrated in FIG. 2, at 1500 rpm, the governor must bring about a reduction in the fuel injection such that a constant power flow is achieved. Only at extremely high rotational speeds of, for example, about 2000 rpm, does the final adjustment result.

Figure 4:
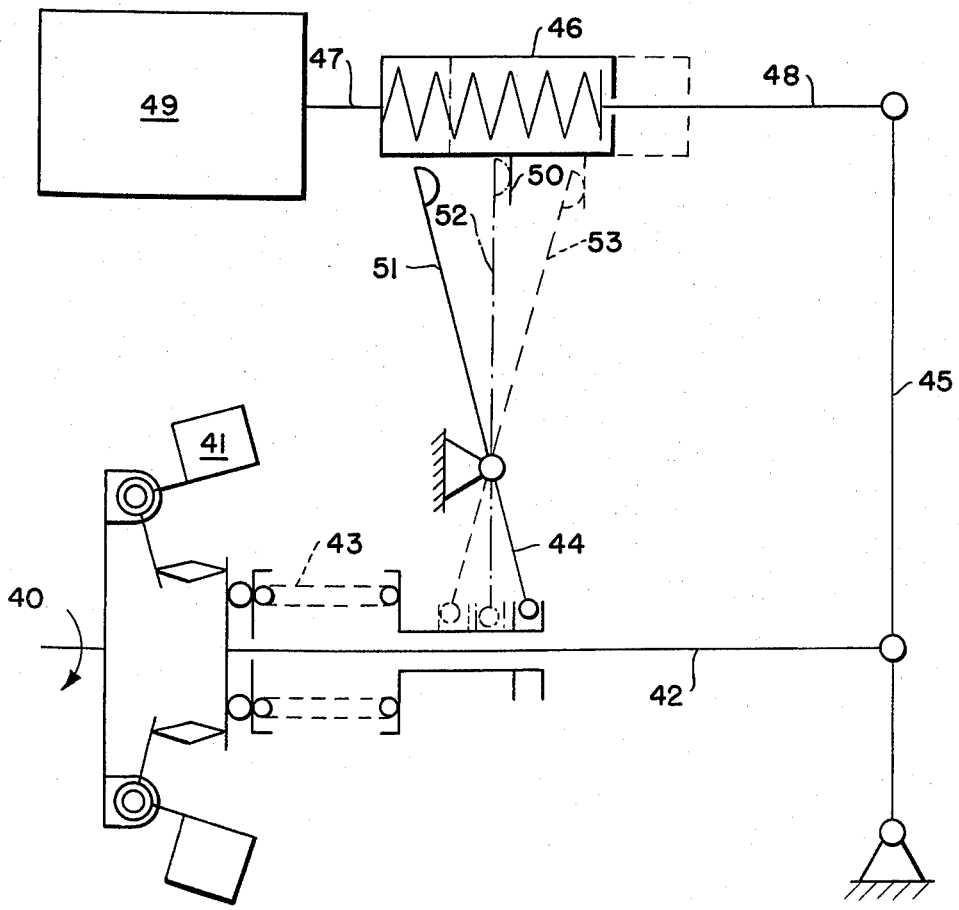
FIG. 4 is a schematic view of a governor control arrangement for a fuel injection pump of a marine propulsion unit in accordance with the present invention.

FIG. 4 provides an example of a governor arrangement for controlling each individual combustion engine 30,31. As shown in FIG. 4, a governing shaft 40 is driven by the respective internal combustion engines 30,31 with fly weights 41 being provided for adjusting a governor coupling 42 in a conventional manner against a force of a governor spring 43. An initial tension of the governor spring 43 can be changed by adjusting a position of a desired-value lever 44 so as to enable an adjustment for different control-desired speeds of the respective engines 30,31. The governor coupling 42 adjusts a governor rod of an injection pump 49 by way of a lever 45. The governor rod in the illustrated embodiment is divided into two sections or members 47, 48 which are interconnected by a spring member 46.

The desired-value lever 44 is adapted to influence the governor rod half 47 by means of a catch or projection 50 connected to the spring member 46.

As shown in FIG. 4, the desired-value lever 44 is adapted to be set in at least three different positions 51, 52, 53. The lever 44 is set in the position 51, shown in solid lines, for an idling rotation and in position 52 for moderate or middle rotational speeds of the engine such as depicted by the point 23 in FIG. 2. In the positions 51 and 52, the lever 44 exercises no influence on the position of the governor rod formed by the sections or members 47,48.

Upon a displacement of the lever 44 to the position 53 so as to obtain a higher desired value of rotational speed, the lever 44 exerts increasing pressure on the spring member 46 and thereby moves the governor rod half 47 by means of the projection or catch 50 away from the full load position, thereby reducing the amount of fuel injected by the fuel injection pump. This results despite the position of the governor coupling 42 and is made possible by virtue of the disposition of the spring member between the sections or members 47, 48 of the governor rod.

Between the positions 51 and 52 of the lever 44, the marine propulsion unit is operated with only one engine 30 or 31 in operation. In the position 52, the second engine is started and between the positions 52 and 53, the drive mechanism is served by both engines 30, 31.

While I have shown and described only one embodiment in accordance with the present invention, it is understood that the same is not limited thereto, but is susceptible of numerous changes and modifications as known to one having ordinary skill in the art, and I therefore do not wish to be limited to the details shown and described herein, but intend to cover all such modifications as are encompassed by the scope of the appended claims.

I claim:

1. A marine propulsion unit which includes at least two diesel engines, a propeller means and means for selectively coupling the diesel engines to the propeller so as to enable the propulsion unit to be operated with less than all of the engines during a medium speed range and to be operated with all engines during higher speed ranges, characterized in that one of the propeller means and coupling means is constructed so that the propeller means absorbs a maximum constant output of those diesel engines operated in the medium speed range with a full amount of fuel being injected to those medium speed operated diesel engines and so that in the higher speed ranges with all engines operating, higher speeds of the propeller means are attained by an increase of the speeds of the diesel engines with exceeding a maximum constant output and with a reduction in the amount of fuel being injected.

2. A marine propulsion unit according to claim 1, characterized in that the coupling means directly couples the propeller means to the engine.

3. A marine propulsion unit according to claim 1, characterized in that the coupling means includes a gear system interposed between the engines and the propeller means.

4. A marine propulsion unit according to claim 3, characterized in that the gear system includes reduction gearing.

* * * * *